US005494124A

United States Patent [19]

Dove et al.

[11] Patent Number: 5,494,124

[45] Date of Patent: Feb. 27, 1996

[54] NEGATIVE PRESSURE VORTEX NOZZLE

[75] Inventors: Norval R. Dove, Houston; Stephen K. Smith, Harker Heights, both of Tex.

[73] Assignee: Vortexx Group, Inc., Houston, Tex.

[21] Appl. No.: 134,085

[22] Filed: Oct. 8, 1993

[51] Int. Cl.[6] ..... E21B 10/60

[52] U.S. Cl. ..... 175/424

[58] Field of Search ..... 175/424, 393, 175/339, 340, 65, 61

[56] References Cited

U.S. PATENT DOCUMENTS

| | | | |
|---|---|---|---|
| 2,901,223 | 8/1959 | Scott | 255/302 |
| 3,528,704 | 9/1970 | Johnson | 299/14 |
| 3,718,699 | 1/1973 | Johnson | 299/14 |
| 4,262,757 | 4/1981 | Johnson, Jr. et al. | 175/67 |
| 4,378,853 | 4/1983 | Chia et al. | 175/340 |
| 4,391,339 | 7/1983 | Johnson, Jr. et al. | 175/393 |
| 4,392,534 | 7/1983 | Miida | 175/340 |
| 4,436,166 | 3/1984 | Hayatavoudi et al. | 175/65 |
| 4,494,618 | 1/1985 | Radtke | 175/393 |
| 4,512,420 | 4/1985 | Hayatdavoudi et al. | 175/67 |
| 4,542,798 | 9/1985 | Madigan | 175/424 X |
| 4,567,954 | 2/1986 | Voight, III et al. | 175/424 |
| 4,623,027 | 11/1986 | Vezirian | 175/340 |
| 4,687,066 | 8/1987 | Evans | 175/340 |
| 5,071,195 | 12/1991 | Komotzki | 175/424 X |

*Primary Examiner*—Michael Powell Buiz
*Attorney, Agent, or Firm*—Matthews & Associates

[57] ABSTRACT

A method and abstract of removing a surface subject to a subsurface pressure and an environmental surface pressure at least equal to the subsurface pressure, which comprises jetting fluid through a nozzle facing and located a predetermined distance from said surface, said nozzle being shaped to eject the fluid in a steam having a higher core pressure than said environmental pressure, said higher pressure stream having adjacent thereto at least one zone of pressure negative relative to said subsurface pressure, said distance being predetermined to expose said surface to said zone of negative pressure, whereby said surface is caused to explode into said zone of negative pressure from the force of said subsurface pressure.

16 Claims, 5 Drawing Sheets

NEGATIVE PRESSURE VORTEX NOZZLE

BACKGROUND OF THE INVENTION

This invention relates to earth formation drilling and drilling hydraulics, and more particularly, to jet bits and nozzles for jet assisted drilling.

Rotary drill bits are used in the drilling of deep holes such as oil wells. Some are polycrystalline diamond compact ("PDC") bits with segmented rows or sectors of diamond hardened cutters; others are rotary cone drill bits. Other types of drill bits can be natural diamond, rock bits, underreamers and coring tools. The rotary cone bits have a plurality of rotating toothed conical cutters with vertices directed toward the centerline of the drill bit. The conical cutters are rotatively borne upon cantilevered journal shafts which extend from the lower periphery of the bit body angularly downward and radially inward relative to the centerline of the vertically cylindrical bit body. In each bit, the bit body upper end is threaded for attachment to the lower end of a drill line made of pipe. In normal drilling operations, the drill line pipe is rotated while forcing the rock bit into the earth. The sectors of teeth in a PDC bit or the cones in a rotary cone bit travel about the centerline of the drill bit and the .rock cutters dig into the geologic formation to fail scrape, crush and/or fracture it.

The bit body also serves the function of a terminal pipe fitting to control and route a drilling fluid flow from inside the drill line pipe out through a plurality of mud nozzles housed in the drill bit and up the annulus between the drill column and the well bore. The drilling fluid accomplishes a number of critically important tasks, the foremost of which is preventing formation fluids from entering the well bore and causing a blowout. Drilling fluids ("muds") are weighted to provide a hydrostatic pressure in the well bore at any given depth that at least equals the formation pressure at the particular depth. Mud weights are usually controlled by adding a high density material such as barite to the mud. Drilling muds are thixotropic fluids that have high viscosity's at low shear rates and low viscosity's at high shear rates. At the high shear rates in bit nozzles, the mud has plastic flow characteristics approaching Newtonian behavior, like water. Jetted from the bit nozzles, it is employed to dissipate the heat of drilling and to flush cuttings from the drilling zone. At the lower shear rates in the annulus between the well bore wall and the drill line pipe, the viscosity increases and is sufficient to buoy cuttings upward to the surface for filtering from the mud. Vertical channels, sometimes called "junk slots, are formed between the exterior wall of the rock bit body adjacent the nozzle locations and the bore hole wall to facilitate the flow of fluid and entrained cuttings from the drilling zone.

Cuttings removal is critically important to the rate of penetration of the drilled formation, for control of viscosity of the drilling fluid, and to minimize wear and tear on drilling rig mud circulation apparatus. Inadequate removal of cuttings from the interface between the cutters teeth of the drill bit and the formation rock causes the more substantial rock chips on the hole bottom to be ground to a paste by the bit. For example, a cube of particle 200 microns on each side, if allowed to remain in the bore hole, could be ground into eight million one micron cubes. These cuttings, called "drilled solids," approach colloidal size and hydrate in the fluid, increasing fluid viscosity at the bit ("plastic viscosity"). As plastic viscosity of the mud increases, drilling rate decreases. This is because the mud must get under a chip quickly so the bit cutters do not grind the chip instead of formation rock. If viscosity is high, the fluid cannot get under the chip rapidly and efficiently flush cuttings from the hole bottom. This impedes the penetration of the rock bit into the geological formation, abrasively wears the cutters of the rock cutters, causes excessive drag, and can produce well bore damage. If the drilled solids are left in the mud, the viscosity of the mud in the annulus increases and can make thick filter cakes that reduce the area for moving mud up the annulus. This can lead to lost circulation and formation damage and to stuck drill pipe.

The prior art has recognized that the pressure differential between the drilling fluid and the formation fluid hinders efficient removal of cuttings from the bore hole bottom and reduces rate of penetration. Various techniques are used to make the fluid emerging from the bit nozzles clean the bottom of the hole. One is to try to make the fluid hit the hole bottom as hard as possible; this is called optimizing hydraulic impact. Another is to try to make the fluid expend as much power across the nozzles as possible; this is called optimizing hydraulic horsepower.

The conventional mud nozzle in the drilling bit is an axially symmetrical, usually circular orifice. Typically a plurality of nozzles are employed. In a PDC bit the jets are spaced in front of the leading edge of a row or sector of teeth, and in a rotary cone bit, a nozzle is provided for each rotary rock cutter, positioned to direct a high velocity fluid stream downward between cutters and against the well bore wall to wash the face of the cutter cones and flush cuttings to the annulus. Generally the stream fans out substantially conically after leaving the nozzle. However, use of these high pressure nozzles for injecting drilling fluid into the bore hole has not satisfactorily provided the desired efficient removal of rock chips to the annulus and the vertical chip channels in the bit body. If the high velocity fluid stream reaches the entrance to the junk channels, the force of the stream can even hinder fluid flow up the channel, exacerbating the pressure differential hold down effect on formation cuttings. Substantial effort has been directed to this continuing problem of cuttings removal and bit balling.

It is also known that turbulent pressure fluctuations have been found to provide lifting forces sufficient to overcome rock chip holddown to remove rock debris from the hole bottom. This technique eases the work of the drill bit itself and facilitates drilling of the well bore.

U.S. Pat. No. 2,901,223 by Scott, proposes a centrally located cluster of three nozzles to discharge radially outward and downward between cutters which are relatively smaller than commonly used to avoid excessive abrasion from the nozzle discharge.

Johnson, in U.S. Pat. No. 3,528,704 and in U.S. Pat. No. 3,713,699 teaches the use of cavitating nozzles directly as cutting tools against the rock. A fluid stream is pulsated at high frequency and enough energy to physically vaporize the fluid in the low pressure phases of the vibratory wave. The vapor bubbles thus produced implode in the high pressure phases of the same waves, and, if very close to the rock surface, cause particles of the rock to erode away in tension. Later variations are described in U.S. Pat. Nos. 4,262,757 and 4,391,339 also to Johnson and in 4,378,853 to Chia.

Hayatdavoudi, in U.S. Pat. Nos. 4,436,166 and 4,512,420, includes a nozzle in a drilling sub above the drilling bit. The nozzle is oriented to eject drilling fluid from the sub into the annulus above the bit with a horizontal velocity component tangential to the annulus, to impart a swirling motion to the drilling fluid in the annulus and create a vortex supposed to suck cuttings radially outward from the cutter formation interface and upward in the annulus.

U.S. Pat. No. 4,687,066 by Evans, is directed to the use of bit nozzles having openings convergingly skewed relative to the bit centerline and to each other to cause expelled drilling fluid to spin downwardly in a vortex to sweep formation cuttings from the cutting face of the rotary cones and move them to the annulus.

In U.S. Pat. 4,623,027 to Vezirian, nozzles are eliminated. The mud column entering the bit is divided into sectors that diverge radially outward from the bit longitudinal centerline in mud snouts that taper downward in cross section and pass vertically between the rotary rock cutters to convey drilling fluid through the bit structure in a smooth laminar flow, relatively free of turbulence and with a minimum of throttling. The mud snouts terminate in a short distance off the rolling path of the rock cutter cones. An advantage of this design is said to be that, as the high pressure fluid stream escapes through the narrow aperture between the mud snout exit and the rock surface, a very high velocity fluid sheet is formed spreading across the hole bottom surface, producing a low pressure region immediately above the rock surface sufficient to lift rock chips and send them off up the annulus toward the surface. It is further said that the pressure drop across the mud snout discharge apertures is relatively low compared to that produced by most mud nozzles, and that as a result no energy is spent in the generation of high energy fluid streams directed downward, that no hold down forces exist, and no high energy fluid streams are produced to block the entrance of the chip clearance channels in the bit periphery.

While these differing approaches to cleaning the bottom of the hole are interesting, none, other than possibly those involving generation of vapor bubbles, are directed to nozzle structure or methods of flowing drilling fluids which cause a destructive fragmenting effect on the virgin rock at hole bottom in addition to hole cleaning.

SUMMARY OF THE INVENTION

Our invention maximizes the rate of penetration of a drill bit, eliminates hydrostatic hold down forces and effectively sweeps cuttings and formation fragments into the annulus, and minimizes a major source of escalating viscosity in the drilling mud. Our invention also impinges a designed and controllable negative hydrostatic pressure differential at the rock cutter interface Our invention does this by creating and locating one or more zones of comparatively negative hydrostatic pressure at the interface of the rock bit cutter cone and the formation rock at the very bottom of the well bore. This formation rock—rock cutter interface represents an insignificant volumetric fraction of the well bore. By reducing the hydrostatic pressure at this localized interface below the threshold of the formation pressures at the depth of the hole bottom, and at no other point in the well bore, the strata at the interface is made to explode with violent force into the well bore below the rock cutter, easing and accelerating the work of the rock cutter. Our invention also creates vortex shedding which introduces turbulent fluctuating pressure within both high and low pressure regions which assist in sweeping cuttings to the periphery of the rock cutter and into the annulus for circulation from the well bore. Changes in drilling fluid flow rate alter the negative hydrostatic pressure values, without change in regime apex focus.

In accordance with our invention, there is provided in a broad sense a method of removing a surface subject to a subsurface pressure and an environmental surface pressure at least equal to the subsurface pressure, which comprises jetting fluid through a nozzle facing and located a predetermined distance from said surface. The nozzle is shaped to eject the fluid in a steam having a higher core pressure than the environmental pressure, and the higher pressure stream has adjacent thereto at least one zone of pressure negative relative to the subsurface pressure. The distance from the surface is predetermined to expose the surface to the zone of negative pressure, such that the surface is caused to explode into the zone of negative pressure from the force of the subsurface pressure.

More particularly in the application of drilling a well bore in an earth formation, our invention comprises (a) rotating a drill bit in the earth formation to form a bore hole, the drilling bit comprising a housing forming an exterior shell having a pin end and rock cutter end, the pin end being connected to a tubular drill string fluidly connected to a drilling fluid supply, the housing having an inlet at the pin end and an interior cavity extending from the inlet to at least one nozzle in the rock cutter end, the one or more nozzles including a passageway fluidly communicating with the cavity and converging to an outlet at the rock cutter end, at least one of the outlets having a slot configuration therein extending to at least a portion of the passageway convergence, the rock cutter end cutting formation at hole bottom; (b) pumping drilling fluid down the drill sting through the cavity, and under turbulent flow conditions through the passageway convergence and the slot configuration out the outlet into the hole bottom into an environment having a hydrostatic pressure at least equal to formation pressure at the drilling depth of the hole bottom, the ejected fluid emerging as a zone of higher hydrostatic pressure than the environmental hole bottom hydrostatic pressure and having adjacent thereto at least one zone of hydrostatic pressure negative relative to the formation hydrostatic pressure, and (c) impinging the negative hydrostatic pressure at the interface of hole bottom rock surface and rock cutter, thereby exploding rock surface into the well bore between the rock cutter end and hole bottom. The zone of higher hydrostatic pressure peripherally degrades from a maximum positive value in a core portion thereof, and the zone of negative hydrostatic pressure peripherally degrades from a maximum negative value in a core portion thereof. The core portion of the negative zone is spaced essentially equidistant from adjacent extremities of the core portion of the higher pressure zone. Vortexes are shed within the pressure zones emitted from the nozzle and clean the hole bottom.

Our invention in a broad sense also encompasses a nozzle comprising a body having first end and second ends. The first end includes means for connection to a fluid supply. The nozzle may be one in which the aforesaid connection is into a drill bit in fluid communication with a fluid supply of drilling fluid. The body has an inlet at the first end and an interior cavity extending from the inlet, the cavity converging to an outlet at the second end. The second end has at least one slot configuration therein included in the outlet and extending to the cavity. The cavity convergence and the slot configuration are effective, when fluid is forced therethrough under turbulent flow conditions into a fluid environment having a positive hydrostatic pressure, to eject the fluid as a zone of higher hydrostatic pressure having adjacent thereto a zone of hydrostatic pressure lower than the environmental hydrostatic pressure thereby resulting in attendent turbulent pressure fluctuations and vortex shedding. Preferably the cavity convergence is frustoconical, and in a particular such aspect, the convergence is at an angle that intersects the axis of the outlet portion exteriorly of the outlet. The slot is suitably plane perpendicular to the axis of the outlet, and is linear or curvilinear, but not circular.

Thus in a particular preference, the nozzle comprises a body having a longitudinal axis, the body defining an interior passageway along the longitudinal axis, the passageway including an inlet at a first end of the body, a frustoconical portion distal from the inlet and a slot portion distal from the inlet conterminously with the frustoconical portion, the slot portion transsecting the frustoconical portion plane perpendicular to the longitudinal axis of the interior passageway, the frustoconical and slot portions terminating in an outlet from the passageway, the outlet including the slot portion.

The invention can generally be described as embodied by a nozzle jet that transitions from an inlet shape to an offset outlet shape with a transition surface designed with different angles of transition so that impingement on a perpendicular plane develops regions of significant negative pressure on or near the plane. Said negative pressures are a new phenomena contrasted to symmetric nozzles that produce only positive pressure on the impingement plane. The asymmetric jets of the present invention have negative toroidal pressure cells that lie above the perpendicular plane.

The present design produces the new phenomena through the choice of the transition surface angles so that selected potions of the negative pressure cells are forced to lie on the impingement surface. Transition angles can cause significant turbulence and control the location of the turbulence and negative pressure regions. Articles near the impingement surface are pulled upward and into the fluid.

In a drill bit application, either integrally formed thereinto or incorporated as an insert thereinto, our invention encompasses a drilling bit comprising a housing forming an exterior shell having a pin end and rock face end. The pin end includes means for connection to a fluid supply. The housing has an inlet at the pin end and an interior cavity extending from the inlet to at least one nozzle in the rock face end. The nozzles include a passageway fluidly communicating with the cavity and converging to an outlet at the rock face end. At least one of the outlets has a slot configuration therein extending to at least a portion of the passageway convergence. The passageway convergence and the slot configuration are effective, when fluid is forced therethrough under turbulent flow conditions into a fluid environment having a positive hydrostatic pressure, to eject the fluid as a zone of higher hydrostatic pressure having adjacent thereto a zone of hydrostatic pressure lower than the environmental hydrostatic pressure.

There are further applications not utilizing an impingement law such as in the drill bit example where the turbulence and distorted negative pressure cells are used for improving mixing of compressible and incompressible mediums, i.e. fuel injection nozzles for internal combustion engines; fuel injection nozzles for coal and water injection into power plant furnaces; sand/water blasting nozzles; and medical mixing applications.

Various preferred embodiments of our invention and test examples demonstrating flow characteristics they have are now set forth, with specific reference to the drawings that are now explained.

DESCRIPTION OF THE PREFERRED EMBODIMENTS

Figure 1:
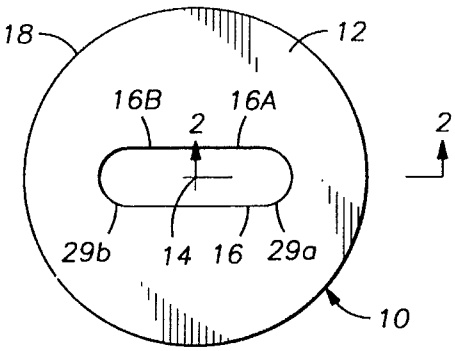
FIG. 1 is a plan view of the outlet end of a nozzle constructed in accordance with our invention and having a rectangular slot with semicircular ends formed in such end and extending into a frustoconically shaped internal passageway.
Figure 2:
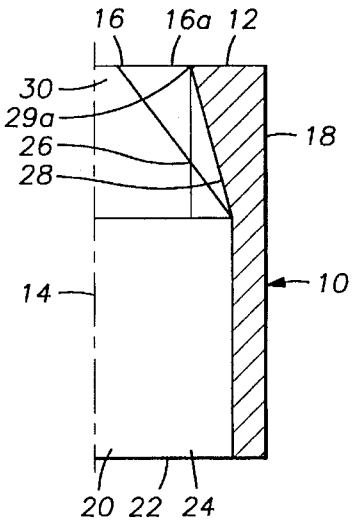
FIG. 2 is a longitudinal sectional view of the nozzle of FIG. 1, taken along the lines 2—2 of FIG. 1.

Referring to FIG. 1, a nozzle 10 constructed in accordance with our invention is depicted in end view, showing an external face 12 which is planar and perpendicular to a central longitudinal axis 14 projecting normal to the plane of the drawing. Nozzle 10 comprises a body 18 which is columnar in shape centered along axis 14. Also centered on axis 14 is an elongated slot 16, each leg 16*a* and 16*b* of which is of equal length from axis 14. Lines 2—2 on FIG. 1 denote the view of nozzle 10 along leg 16*a* seen in FIG. 2. Referring to FIG. 2, nozzle body 18 defines a passageway indicated generally by reference numeral 20, a sector of which is seen. Passageway 20 comprises an entrance portion 22 which includes an inlet 24 at the end of body 18 distal from external face end 12. Distal from inlet entrance 24 in passageway 20 is a portion 26 which commences in the floor 25 of entrance portion 22 and cross-sectionally tapers inwardly to longitudinal axis 14 at a predetermined angle, in the example depicted, an angle of rotation of 35° from the longitudinal axis 14, describing a frustoconical surface for passageway portion 26, the apex of the cone being at a point of projection on axis 14 outside and beyond external face 14.

Passageway 20 includes a second portion 28 distal from inlet 24. Portion 28 commences with portion 26 at the floor 25 of entrance passageway portion 22 and rising in a slotted shape at a lesser angle from floor 25 channels a recess 29*a* in the more steeply rising frustoconical surface 26. The angle of incline from the floor 25 intersects a point on the axis 14 projected beyond the apex intersection of surface 26. The same sector as viewed in FIG. 2 is found in the other leg 16*b* of ellipse slot 16. The surface 26 and recesses 29*a* and sister recess 29*b* terminate in outlet 16. Outlet 16 thus includes a central portion indicated by reference numeral 30 where the top of each recess 29*a* and 29*b* most distal from inlet 24 cuts the periphery of the frustum opening of frustoconical surface 26. Outlet 16 also comprises the portions of the slot recess 29*a* and 29*b* most distal from inlet 24 which open to the exterior face 12.

Figure 3:
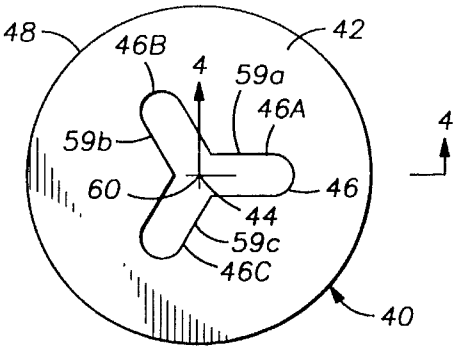
FIG. 3 is a plan view of the outlet end of a nozzle constructed in accordance with our invention and having star or a tri-legged slots with semicircular ends formed in such end and extending into a frustoconically shaped internal passageway.
Figure 4:
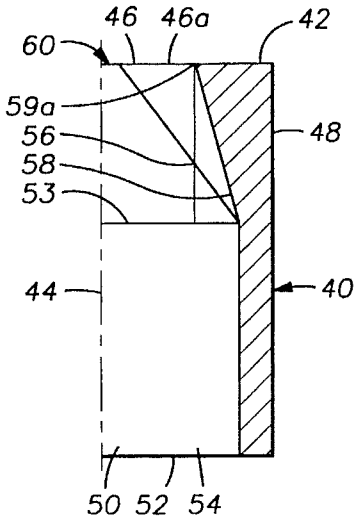
FIG. 4 is a longitudinal sectional view of the nozzle of FIG. 4, taken along the lines 4—4 of FIG. 3.
Figure 5:
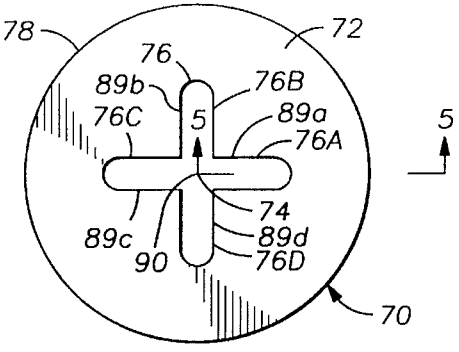
FIG. 5 is a plan view of the outlet end of a nozzle constructed in accordance with our invention and having a cross shaped slot each leg of which has semicircular ends formed in such end and extending into a frustoconically shaped internal passageway.
Figure 6:
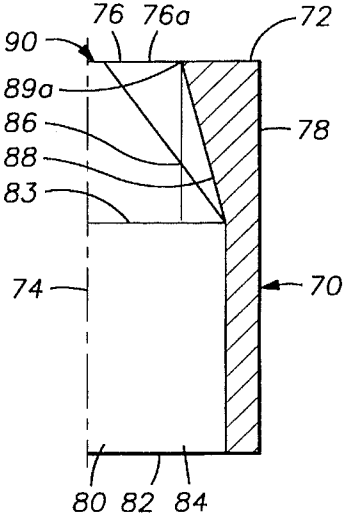
FIG. 6 is a longitudinal sectional view of the nozzle of FIG. 5, taken along the lines 6—6 of FIG. 5.

Referring to FIG. 3, a nozzle 40 constructed in accordance with our invention is depicted in end view, showing an external face 42 which is planar and perpendicular to a central longitudinal axis 44 projecting normal to the plane of the drawing. Nozzle 40 comprises a body 48 which is columnar in shape centered along axis 44. Also centered on axis 44 is a tri-legged or star shaped slot 46, each leg 46*a*, 46*b* and 46*c* of which is of equal length from axis 44. Lines 4—4 on FIG. 3 denote the view of nozzle 40 along leg 46*a* seen in FIG. 4. Referring to FIG. 4, nozzle body 48 defines a passageway indicated generally by reference numeral 50, a sector of which is seen. Passageway 50 comprises an entrance portion 52 which includes an inlet 54 at the end of body 48 distal from external face end 42. Distal from inlet entrance 54 in passageway 50 is a portion 56 which commences in the floor 53 of entrance portion 52 and cross-sectionally tapers inwardly to longitudinal axis 44 at a predetermined angle, in the example depicted, an angle of rotation of 35° from the longitudinal axis 44, describing a frustoconical surface for passageway portion 56, the apex of the cone being at a point of projection on axis 44 outside and beyond external face 44. Passageway 50 includes a second portion 58 distal from inlet 54. Portion 58 commences with portion 56 at the floor 53 of entrance passageway portion 52 and rising in a slotted shape at a lesser angle from floor 53 channels a recess 59*a* in the more steeply rising frustoconical surface 56. The angle of incline from the floor 52 intersects a point on the axis 44 projected beyond the apex intersection of surface 56. The same sector as viewed in FIG. 5 is found in each of the other two legs 46*b* and 46*c* of star slot 46, . The surface 56 and recesses 59*a* and sister recesses 59*b* and 59*c* terminate in outlet 46. Outlet 46 thus includes a central portion indicated by reference numeral 60 where the top of each recess 59*a*, 59*b* and 59*c* most distal from inlet 54 cut the periphery of the frustum opening of frustoconical surface 56. Outlet 46 also comprises the portions of the slot recesses 59*a*, 59*b* and 59*c* most distal from inlet 54 which open to the exterior face 42.

Referring to FIG. 5, a nozzle 70 constructed in accordance with our invention is depicted in end view, showing an external face 72 which is planar and perpendicular to a central longitudinal axis 74 projecting normal to the plane of the drawing. Nozzle 70 comprises a body 78 which is columnar in shape centered along axis 74. Also centered on axis 74 is a four legged or cross shaped slot 76, each leg 76*a*, 76*b*, 76*c* and 76*d* of which is of equal length from axis 74. Lines 6—6 on FIG. 5 denote the view of nozzle 70 along leg 76*a* seen in FIG. 5. Referring to FIG. 5, nozzle body 78 defines a passageway indicated generally by reference numeral 80, a sector of which is seen. Passageway 80 comprises an entrance portion 82 which includes an inlet 84 at the end of body 78 distal from external face end 72. Distal from inlet entrance 84 in passageway 80 is a portion 86 which commences in the floor 83 of entrance portion 82 and cross-sectionally tapers inwardly to longitudinal axis 74 at a predetermined angle, in the example depicted, an angle of rotation of 35° from the longitudinal axis 74, describing a frustoconical surface for passageway portion 86, the apex of the cone being at a point of projection on axis 74 outside and beyond external face 74. Passageway 80 includes a second portion 88 distal from inlet 84. Portion 88 commences with portion 86 at the floor 83 of entrance passageway portion 82 and rising in a slotted shape at a lesser angle from floor 83 channels a recess 89*a* in the more steeply rising frustoconical surface 86. The angle of incline from the floor 82 intersects a point on the axis 74 projected beyond the apex intersection of surface 86. The same sector as viewed in FIG. 5 is found in each of the other three legs 76*b*, 76*c* and 76*d* of star slot 76, . The surface 86 and recesses 89*a* and sister recesses 89*b*, 89*c* and 86*d* terminate in outlet 76. Outlet 76 thus includes a central portion indicated by reference numeral 90 where the top of each recess 89*a*, 89*b*, 89*c* and 89*d* most distal from inlet 84 cuts the periphery of the frustum opening of frustoconical surface 86. Outlet 76 also comprises the portions of the slot recesses 89*a*, 89*b*, 89*c* and 89*d* most distal from inlet 84 which open to the exterior face 72.

EXAMPLE 1

Nozzle of FIG. 1

Figure 7:
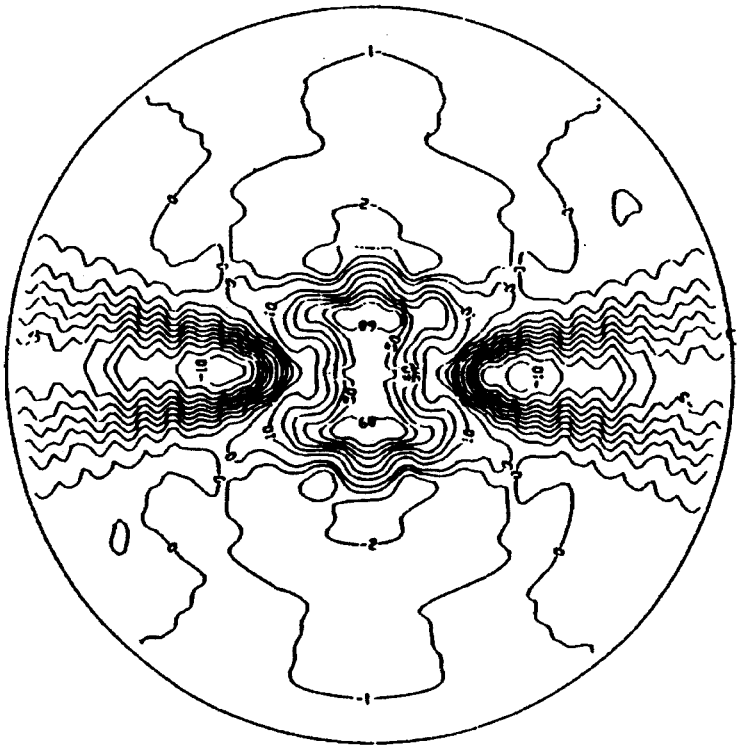
FIG. 7 is a diagram of the lines of relative pressure projected by a fluid forced under pressure through the nozzle of FIG. 1, under the test conditions described in Example 1.

The nozzle of FIG. 1 was tested in a fixture setup as follows. The nozzle body had an overall length of 2.75 inches, an outside OD of 2.375 inches, an outlet width of 0.4030 inches and an outlet length of 1.327 inches. Total area of the nozzle outlet was 0.5 $in^2$. (This nozzle size may be compared as follows to typical nozzle jet area in a drilling bit for a 12¼ inch bore hole: Typical jet sizes for said hole are two "12's". one "13"; the cross sectional area of a "12" is 0.1104 $in^2$; the cross sectional area OD a "13" is 0.1296; thus total cross sectional jet area is 0.3505 $in^2$ and total cross sectional area of the hole is 117.859 $in^2$, for a ratio of typical jet area to hole area of 0.003. Using the same ratio for the 0.5 $in^2$ nozzle outlet, hole area is 168.123 $in^2$ and hole diameter is 14.631 $in^2$.) A tank of dimensions 4.15 feet long, 3.69 feet wide and 2 feet deep having a capacity of 229.09 gallons was employed with a 3 by 2 centrifugal pump acting on water as a test fluid. A pressure/vacuum transducer model PU350 manufactured by John Fluke Manufacturing Company, Inc., capable of measuring 0–500 psig with full vacuum function, with analog to digital voltmeter readout was employed with a pressure measuring fixture comprising a flat plate translatable in two axes, one perpendicular to flow, the other parallel to flow. A ⅜ inch OD×3/16 inch ID nipple projected 3/16 inch above the plate. Pressure readings were taken at ¼ inch increments perpendicular to the flow from center of the jet to three inches radially outward from the centerline. Flow rate was 165 GPM, plate depth was 12 inches below the static waterline, nozzle discharge pressure was 68 psig static, pressure at the plate was 0 psig transducer calibrated to read zero at 12 inches depth), the nozzle to plate distance was 1.625 inches, and water temperature was 90° F. The data from these tests are set forth in FIG. 11. Mapped from the foregoing data are second derivative topographical pressure profiles depicted in FIG. 7.

From the mapped pressure profiles, it is clearly revealed that the nozzle of FIG. 1 produces a rectangular dog bone zone of positive hydrostatic pressures that degrades from a maximum positive value in a core portion thereof at the ends of the "dog bone" to a zero reference value in distal peripheries thereof. Further it is seen that the nozzle of FIG. 1 produces a zone of negative hydrostatic pressure adjacent each long dimension of the high pressure zone, that each of these zones of negative hydrostatic pressure degrades from a maximum negative value in a core portion to a zero reference value at a most distal pressure periphery, and that the negative zone is symmetrically spaced essentially perpendicular to and equidistant from the adjacent long dimension extremities of the core portion of the positive zone.

EXAMPLE 2

Nozzle of FIG. 3

Figure 8:
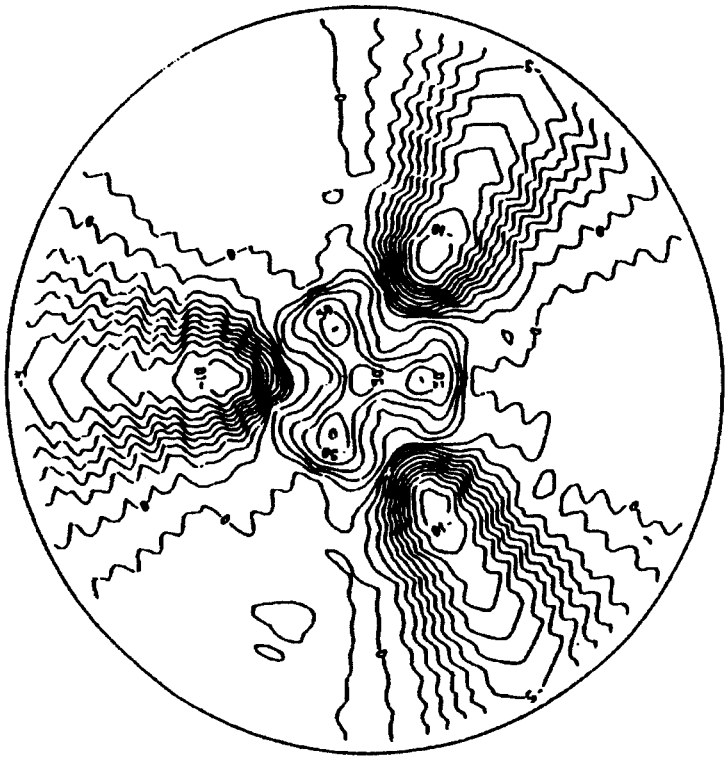
FIG. 8 is a diagram of the lines of relative pressure projected by a fluid forced under pressure through the nozzle of FIG. 3, under the test conditions described in Example 2.

The star nozzle of FIG. 3 was tested in the same fixture setup as in Example 1 and under the same conditions described in Example 1, except water temperature was 100° F. The nozzle body had an overall length of 2.75 inches, an outside OD of 2.375 inches, a single leg width of 0.289 inches and a single leg length of 0.650 inches. Total area of the nozzle outlet was 0.5 $in^2$. The data from these tests are set forth in Table 2. Mapped from the data in Table 2 are first derivative topographical pressure profiles depicted in FIG. 8.

From the mapped pressure profiles of Example 2, it is clearly revealed that the nozzle of FIG. 3 produces a tri-lobular zone of positive hydrostatic pressures that degrades from a maximum positive value in a core portion thereof at center and at the lobes to a zero reference value in distal peripheries thereof. Further it is seen that the nozzle of FIG. 3 produces a zone of negative hydrostatic pressure adjacent and between each union of a lobe leg of the high pressure zone, that each of these zones of negative hydrostatic pressure degrades from a maximum negative value in a core portion to a zero reference value at a distal pressure periphery, and that the negative zone is symmetrically spaced essentially equidistant from adjacent leg extremities of the core portion of the positive zone.

EXAMPLE 3

Nozzle of FIG. 5

Figure 9:
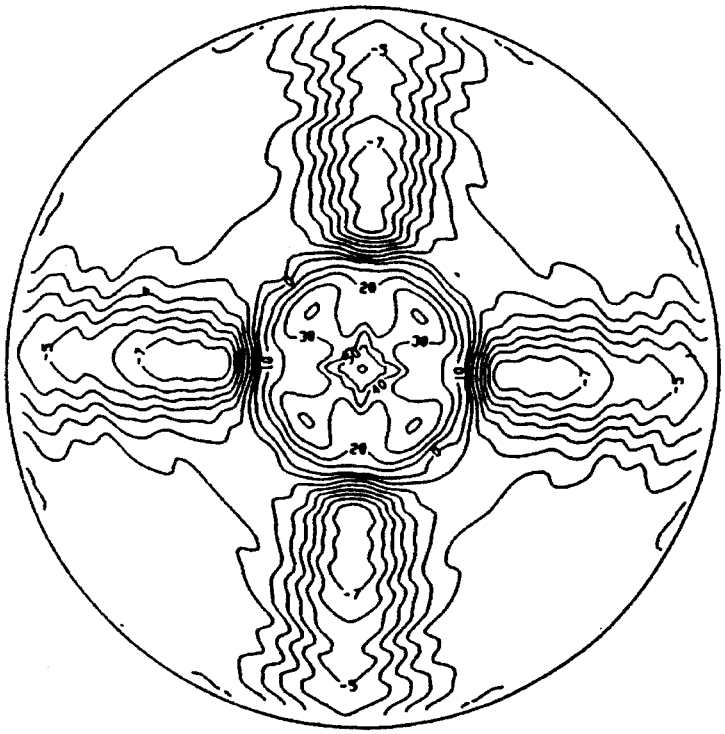
FIG. 9 is a diagram of the lines of relative pressure projected by a fluid forced under pressure through the nozzle of FIG. 5, under the test conditions described in Example 3.
Figure 11:
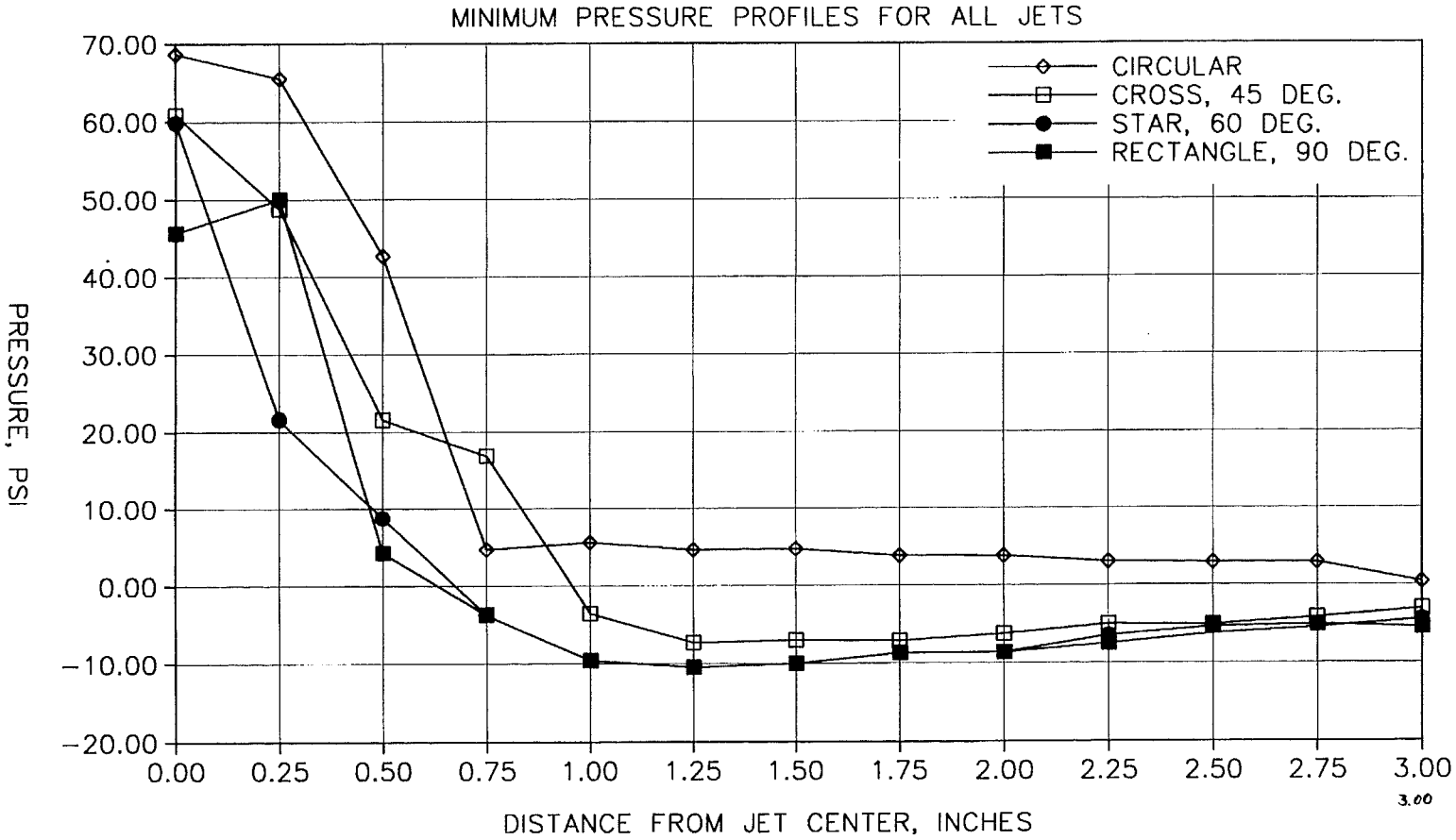
FIG. 11 is a graph of the minimum pressure profiles measured at radial distances from nozzle jet centerline for the nozzle lets of FIGS. 1–6 in comparison to the minimum pressure profile for a prior art circular nozzle outlet.

The cross nozzle of FIG. 5 was tested in the same fixture setup as in Example 1 and under the same conditions described in Example 1, except water temperature was 90° F. The nozzle body had an overall length of 2.75 inches, an outside OD of 2.375 inches, a single cross arm width of 0.220 inches and a single cross arm length of 1.292 inches. Total area of the nozzle outlet was 0.5 $in^2$. The data from these tests are set forth in FIG. 11. Mapped from the data in FIG. 11 are first derivative topographical pressure profiles depicted in FIG. 9.

From the mapped pressure profiles of Example 3, it is clearly revealed that the nozzle of FIG. 5 produces a cruciform zone of positive hydrostatic pressures that degrades from a maximum positive value in a central core portion thereof at center to a zero reference value in distal peripheries thereof. Further it is seen that the nozzle of FIG. 5 produces a zone of negative hydrostatic pressure adjacent and between each union of a cross arm of the high pressure zone, that each of these zones of negative hydrostatic pressure degrades from a maximum negative value in a core portion to a zero reference value at a distal pressure periphery, and that the negative zone is symmetrically spaced essentially equidistant from adjacent arm extremities of the core portion of the positive zone.

EXAMPLE 4

Prior Art Circular Nozzle

Figure 10:
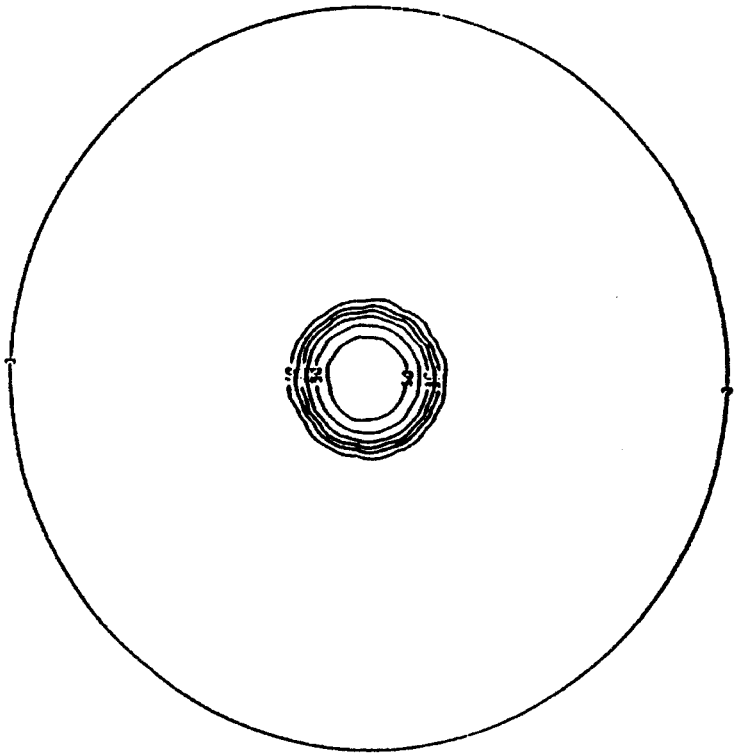
FIG. 10 is a diagram of the lines of relative pressure projected by a fluid forced under pressure through a circular prior art nozzle, under the test conditions described in Example 3.

A circular jet nozzle was tested in the same fixture setup as in Example 1 and under the same conditions described in Example 1, except water temperature was 100° F. and orientation of the plate was only the zero degrees from major axis case. The nozzle body had an overall length of 2.75 inches, an outside OD of 2.375 inches, and an outlet diameter of 0.399 inches. Total area of the nozzle outlet was 0.5 $in^2$. The data from these tests are set forth in FIG. 11. Mapped from the data in Table 4 are first derivative topographical pressure profiles depicted in FIG. 10.

From the mapped pressure profiles of Example 4, it is clearly revealed that the circular prior art nozzle configuration nozzle of FIG. 5 produces a circumferentially degrading zones of positive hydrostatic pressures. Further it is seen that the prior art nozzle does not produce adjacent zones of negative hydrostatic pressure.

Referring to FIG. 11, the minimum pressure profiles for the nozzle configurations tested as described in Examples 1–3 are graphed at values for radial distances from nozzle jet centerline for the nozzle jets of FIGS. 1–6 in comparison to the minimum pressure profile for the prior art circular nozzle outlet described in Example 4. FIG. 11 illustrates that all configurations of nozzles in accordance with this invention achieved a negative hydrostatic pressure whereas a negative hydrostatic pressure was not attained with the circular prior art nozzle.

Figure 12:
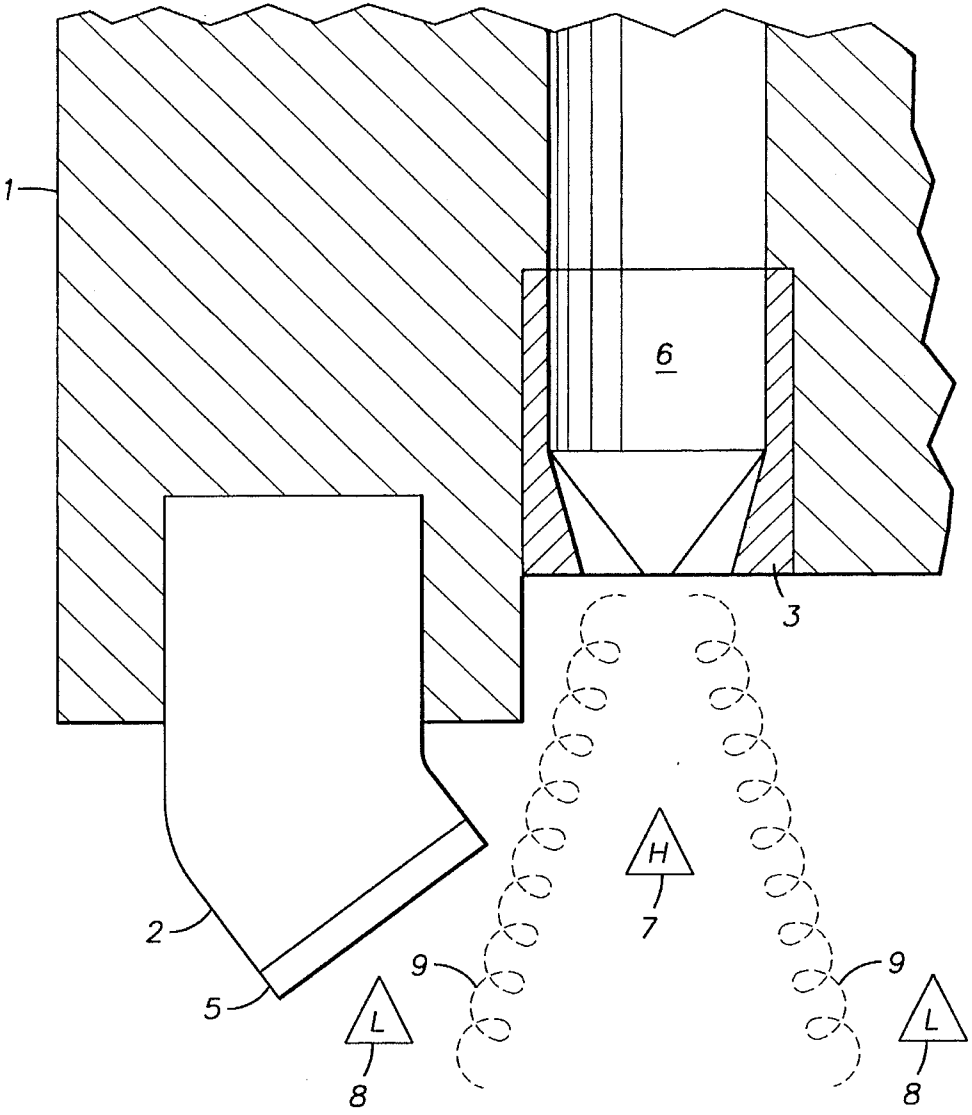
FIG. 12 is a schematic representation showing a zone of negative hydrostatic pressure impinged at the rock-cutter interface of a formation and zones of positive pressure along which vortexes are illustrated shedding.

Referring to FIG. 12, the co-action of the negative hydrostatic pressure zones and the positive hydrostatic pressure zones and associated shed vortexes is illustrated. In the figure it is shown that the vortexes are essentially located about the periphery of the high pressured areas. It is this relationship along with the design of the nozzle in its location of the drill bit that gives rise to the beneficial features discussed herein. Disclosed in FIG. 12 is the bit body 1 with a cutter 2 extending therefrom. A nozzle of the present invention 3 is mounted on the bit body 1 with vortexes 4 just in front of the cutter face 5 of cutter 2. The high pressure areas resulting from the fluid 6 being forced through nozzle 3 are depicted as delta H7 while the low pressure areas are depicted as Delta L8 and the resulting vortexes being depicted as 9.

Other variations of the embodiments can be utilized in accordance with this invention. As discussed previously, the various openings of the nozzle described in this section are not intended to limit the invention to such specific designs. The slot opening of the nozzle of the present invention can take the form of virtually any curvilinear or geometric design other than a plain circle. The face of the nozzle can also be other than flat, including concave or convex.

Thus, it is apparent that they are provided, in accordance with the present invention, a vortex, a negative pressure vortex nozzle for use with underground drilling apparatus. While the invention has been described in conjunction with specific embodiments thereof, it is evident that many alternatives, modifications and variations will be apparent to those skilled in the art in light of the foregoing description. Accordingly, this patent is intended to embrace all such alternatives, modifications and variations as falling within the spirit of the invention and scope of the appended claims.

We claim:

1. A nozzle comprising a body having first end and second ends, said first end including means for connection to a fluid supply, said body having an inlet at said first end and an interior cavity extending from said inlet, said cavity converging to an outlet at said second end, said second end having at least one slot configuration therein included in said outlet and extending to said cavity, said cavity convergence reaching a maximum at said slot and together being effective, when fluid is forced therethrough under turbulent flow conditions into a fluid environment having a positive hydrostatic pressure, to eject said fluid as a zone of higher hydrostatic pressure than the environment hydrostatic pressure having adjacent thereto a zone of hydrostatic pressure lower than said environment hydrostatic pressure.

2. The nozzle of claim 1 in which said convergence is to a longitudinal axis and is axially symmetrical.

3. The nozzle of claim 1 in which said convergence is to a longitudinal axis and is axially asymmetrical.

4. The nozzle of claim 2 in which said cavity convergence is frustoconical.

5. The nozzle of claim 4 in which the convergence is at an angle that intersects the axis of said outlet portion exteriorly of said outlet.

6. The nozzle of claim 1 in which said slot is plane parallel to the axis of said outlet.

7. The nozzle of claim 1 in which said slot is linear.

8. The nozzle of claim 1 in which said slot is curvilinear.

9. The nozzle of claim 1 in which said connection is into a drill bit in fluid communication with a fluid supply of drilling fluid.

10. The nozzle of claim 2 wherein said slot has at least two ends, said ends being equal distance from the geometric center of the nozzle.

11. The nozzle of claim 1 wherein said slot comprises at least two ends, said ends being non-equal distance from the geometric center of the nozzle.

12. The nozzle in claim 1 wherein said converging cavity comprises a frustoconical passageway through which the drilling fluid passes, said passageway tapering inwardly toward the longitudinal axis of said nozzle at a predetermined angle, the apex of which being at a point of projection on the longitudinal axis beyond said outlet; and a second incline surface inclined toward said longitudinal axis within said passageway at a lesse angle of incline than said first frustoconical surface originating at the intersection of said cylindrical portion and said frustoconical portion.

13. A nozzle, for a drilling bit which comprises a body having a longitudinal axis, said body defining an interior passageway along said longitudinal axis, said passageway including an inlet at a first end of the body, a frustoconical portion distal from said inlet and a slot portion distal from said inlet conterminous with said frustoconical portion, said slot portion transsecting said frustoconical portion in a plane parallel to said longitudinal axis, said frustoconical and slot portions simultaneously terminating in an outlet from said passageway, said outlet including said slot portion.

14. A nozzle for conducting and directing drilling fluid through a drilling or cutting mechanism comprising:

a body having an inlet end and an outlet end;

a cavity within said body forming a fluid connection from said inlet end to said outlet end, said cavity having a cylindrical portion adjacent said inlet end and continuously converging end, said cavity having a cylindrical portion adjacent said inlet end and continuously converging and reducing in cross-sectional area from said cylindrical portion to said outlet end; and said outlet end includes means for ejecting a non-cavitating, non-resonating stream of drilling fluid from said outlet into a fluid environment having an existing pressure in a manner to create a zone of hydrostatic pressure greater than said existing pressure and an adjacent zone of hydrostatic pressure lower than said existing pressure.

15. The invention as claimed in claim 14, wherein:

said ejecting means includes a non-circular orifice shaped to impart to said stream zones of pressure less than said existing pressure at the surface of the material being drilled.

16. The invention as claimed in claim 14, wherein:

said outlet end includes at least one radial slot through which said drilling fluid is ejected from said nozzle into said environment.

* * * * *

UNITED STATES PATENT AND TRADEMARK OFFICE

CERTIFICATE OF CORRECTION

PATENT NO. : 5,494,124
DATED : February 27, 1996
INVENTOR(S) : Norval R. Dove, Stephen K. Smith, W. Gerald Lott

It is certified that error appears in the above-indentified patent and that said Letters Patent is hereby corrected as shown below:

On title page, item [75], both should be changed to
and W. Gerald Lott, all--.

On title page, item [57], line 1,
"abstract" should be changed to --apparatus--.

Signed and Sealed this

Tenth Day of September, 1996

*Attest:*

Bruce Lehman

BRUCE LEHMAN

*Attesting Officer*

*Commissioner of Patents and Trademarks*